US005659277A

United States Patent [19]

Joshi et al.

[11] Patent Number: 5,659,277

[45] Date of Patent: Aug. 19, 1997

[54] SUPERCONDUCTING MAGNETIC COIL

[75] Inventors: Chandrashekhar H. Joshi, Bedford; John P. Voccio, Somerville, both of Mass.

[73] Assignee: American Superconductor Corporation, Westborough, Mass.

[21] Appl. No.: 302,358

[22] Filed: Sep. 7, 1994

[51] Int. Cl.[6] ..... H01F 1/00

[52] U.S. Cl. ..... 335/216; 335/299; 324/318; 505/211

[58] Field of Search ..... 335/216, 296, 335/299, 301; 336/DIG. 1; 324/318, 319, 320; 505/211, 230, 231, 232, 705, 844, 879, 880

[56] References Cited

U.S. PATENT DOCUMENTS

| | | | |
|---|---|---|---|
| 4,623,864 | 11/1986 | Inoue et al. | 335/299 |
| 4,990,878 | 2/1991 | Takechi et al. | 335/301 |
| 5,132,278 | 7/1992 | Stevens et al. | 505/1 |
| 5,136,273 | 8/1992 | Ohta | 335/301 |
| 5,138,326 | 8/1992 | Edwards et al. | 324/319 |

OTHER PUBLICATIONS

Jerry A. Selvagol et al., "A 124 Warm Bore Superconducting Ironclad High Gradient Magnetic Separator", Applied Superconductivity, vol. 1, No. 1/2, pp. 13–18, 1993.

Farrel, et. al., Suprconducting properties of aligned crystalline grains of Y1Ba2Cu3O7, Physical Review B, pp. 4025–4027. Sep. 1, 1987.

*Primary Examiner*—Lincoln Donovan

*Attorney, Agent, or Firm*—Fish & Richardson P.C.

[57] ABSTRACT

A superconducting magnetic coil formed of anisotropic high temperature superconducting material includes ferromagnetic flanges positioned coaxial to the longitudinal axis of the coil and at the ends of the superconducting coil to capture magnetic flux emanating from the coil so that the maximum perpendicular magnetic field at the end regions is reduced. A reduction in the maximum perpendicular magnetic field increases the critical current at the end regions thereby increasing the critical current at these regions and maintaining an overall higher critical current of the coil.

12 Claims, 13 Drawing Sheets

SUPERCONDUCTING MAGNETIC COIL

BACKGROUND OF THE INVENTION

The invention relates to superconducting magnetic coils.

As is known in the art, the most spectacular property of a superconductor is the disappearance of its electrical resistance when it is cooled below a critical temperature $T_c$. Another important property is the loss of superconductivity by the application of a magnetic field equal to or greater than a critical field $H_c$. The value of $H_c$, for a given superconductor, is a function of the temperature, given approximately by $$H_c=H_o(1-T^2/T_c^2)$$

where $H_o$, the critical field at 0° K., is, in general, different for different superconductors. For applied magnetic fields less than $H_c$, the current carrying capacity decreases monotonically with an increasing applied field.

The existence of a critical field implies the existence of a critical transport electrical current, referred to more simply as the critical current ($I_c$) of the superconductor. The critical current is the current at which the material loses its superconducting properties and reverts back to its normally conducting state.

Superconducting materials are generally classified as either low or high temperature superconductors. High temperature superconductors (HTS), such as those made from ceramic or metallic oxides are anisotropic, meaning that they generally conduct better, relative to the crystalline structure, in one direction than another. Moreover, it has been observed that, due to this anisotropic characteristic, the critical current varies as a function of the orientation of the magnetic field with respect to the crystallographic axes of the superconducting material. Anisotropic high temperature superconductors include, but are not limited to, the family of Cu-O-based ceramic superconductors, such as members of the rare-earth-copper-oxide family (YBCO), the thallium-barium-calcium-copper-oxide family (TBCCO), the mercury-barium-calcium-copper-oxide family (HgBCCO), and the bismuth strontium calcium copper oxide family (BSCCO). These compounds may be doped with stoichiometric amounts of lead or other materials to improve properties (e.g., $(Bi,Pb)_2Sr_2Ca_2Cu_3O_{10}$).

High temperature superconductors may be used to fabricate superconducting magnetic coils such as solenoids, racetrack magnets, multipole magnets, etc., in which the superconductor is wound into the shape of a coil. When the temperature of the coil is sufficiently low that the HTS conductor can exist in a superconducting state, the current carrying capacity as well as the magnitude of the magnetic field generated by the coil is significantly increased.

Referring to FIG. 1, in fabricating such superconducting magnetic coils, the superconductor may be formed in the shape of a thin tape 5 which allows the conductor to be bent around relatively small diameters. The thin tape is fabricated as a multi-filament composite superconductor including individual superconducting filaments 7 which extend substantially the length of the multi-filament composite conductor and are surrounded by a matrix-forming material 8, which is typically silver or another noble metal. Although the matrix forming material conducts electricity, it is not superconducting. Together, the superconducting filaments and the matrix-forming material form the multi-filament composite conductor. In some applications, the superconducting filaments and the matrix-forming material are encased in an insulating layer (not shown). The ratio of superconducting material to matrix-forming material is known as the "fill factor" and is generally less than 50%. When the anisotropic superconducting material is formed into a tape, the critical current is often lower when the orientation of an applied magnetic field is perpendicular to the wider surface of the tape, as opposed to when the field is parallel to this wider surface.

SUMMARY OF THE INVENTION

In one aspect of the invention, a ferromagnetic member is disposed proximally to and spaced from end portions of an anisotropic superconducting coil to reduce perpendicular magnetic field components of the magnetic field present, particularly at the end portions of the coil.

For example, positioning ferromagnetic material at the ends of a superconducting magnetic coil that is fabricated from anisotropic superconductor materials increases an otherwise low critical current characteristic associated with and caused by the perpendicular orientation of the magnetic field generally found at the end region of the coil. By decreasing the perpendicular field component of the magnetic field at the end regions, the critical current density value associated with the end regions is maintained closer to that associated with more central regions of the coil. Because the magnetic field associated with a superconducting coil is directly related to the current carrying capacity of the coil, a concomitant overall increase in the magnetic field provided by the coil is also achieved.

Generally, for a superconducting solenoid having a uniform distribution of high temperature superconductor tape wound along its axial length, the magnetic field lines emanating from the coil at its end regions becomes less parallel with respect to the plane of the conductor (the conductor plane being parallel to the wide surface of the superconductor tape). As the magnetic field lines become increasingly perpendicular with respect to the conductor plane the critical current density at the end regions drops significantly. Although the critical current density is relatively high at the regions more central to the coil—where the magnetic field lines are generally parallel—the sharp decrease in the critical current density at the end regions provides an overall decrease in the current carrying capacity of the coil in its superconducting state.

Particular embodiments of the invention include one or more of the following features. The ferromagnetic member has an inner radial portion proximal to the axis of the coil that is spaced further from the end portion of the coil than an outer radial portion of the ferromagnetic member. The thickness of the inner radial portion is less than that at the outer radial portion. A ferromagnetic member is disposed proximally to and spaced from each end of the coil. The ferromagnetic member comprises a material selected from the group consisting of iron, cobalt, nickel, gadolinium, holmium, terbium, dysprosium, or alloys thereof. The anisotropic superconductor is a high temperature superconductor and, preferably comprises a high temperature copper oxide superconductor, a BSCCO compound, such as $(Pb,Bi)_2Sr_2Ca_2Cu_3O$. The superconductor may be a mono-filament or a multi-filament composite superconductor including individual superconducting filaments which extend the length of the multi-filament composite conductor and are surrounded by a matrix-forming material. The sections of the superconductor are formed of pancake or double pancake coils.

In another aspect of the invention, ferromagnetic flanges are positioned at the ends of a superconducting coil assembly including a plurality of superconducting magnetic coils of the type described above, with each coil coaxially positioned and spaced from an adjacent coil along a longitudinal axis of the coil assembly. The coil assembly provides a relatively uniform field along the longitudinal axis of the coil assembly with the ferromagnetic flanges reducing the perpendicular magnetic field components of the magnetic field present at the end regions of the coil assembly.

In another aspect of the invention, a method for providing a magnetic coil formed of a preselected anisotropic superconductor material wound about a longitudinal axis of the coil and having a ferromagnetic member positioned proximal to at least one end region of the coil, features the following steps:

a) selecting a thickness of the ferromagnetic member to provide a maximum flux density below a saturation flux density of the member, b) positioning the ferromagnetic member at at least one end region of the coil, c) spacing the ferromagnetic member along the longitudinal axis of the coil to provide a minimum perpendicular magnetic field component at the end region of the coil.

In preferred embodiments, the method features the additional step of determining the radial position at which the end perpendicular field component is at a maximum and then removing a portion of the ferromagnetic material at the radial position corresponding to the maximum perpendicular field component.

Other advantages and features will become apparent from the following description and the claims.

DESCRIPTION OF THE PREFERRED EMBODIMENT

Figure 1:
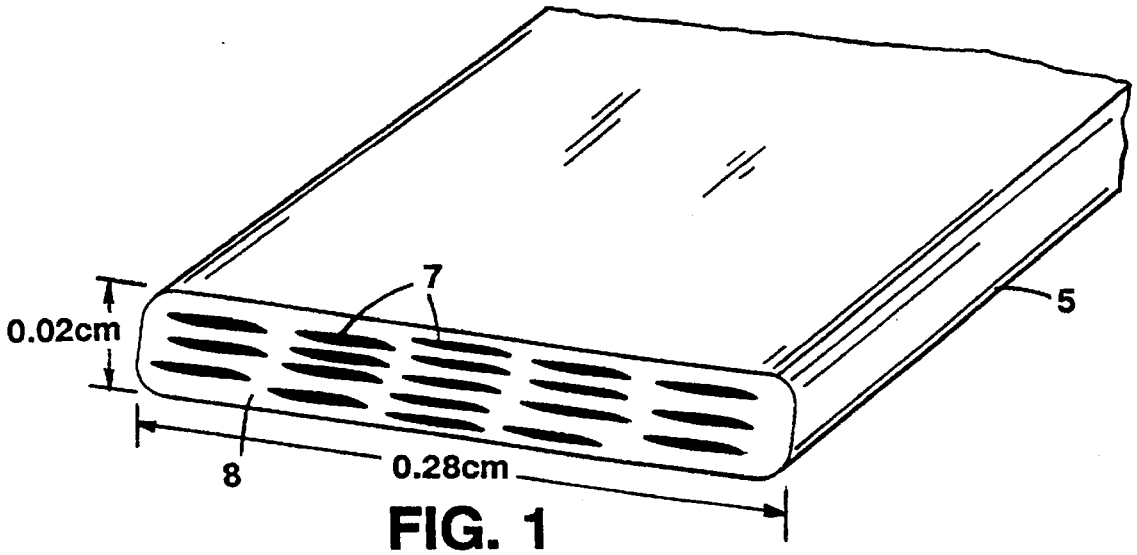
FIG. 1 (PRIOR ART)
FIG. 1 is a cross-sectional view of a multi-filament composite conductor.
Figure 2:
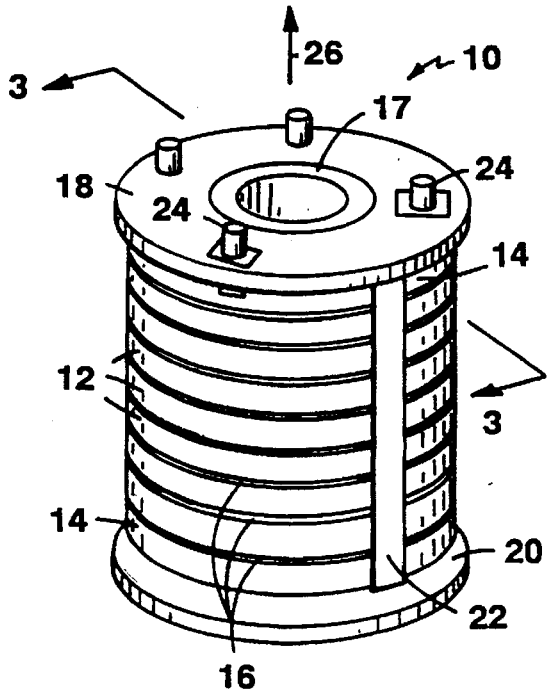
FIG. 2 is a perspective view of a multiply stacked superconducting coil having "pancake" coils and iron flanges.
Figure 3:
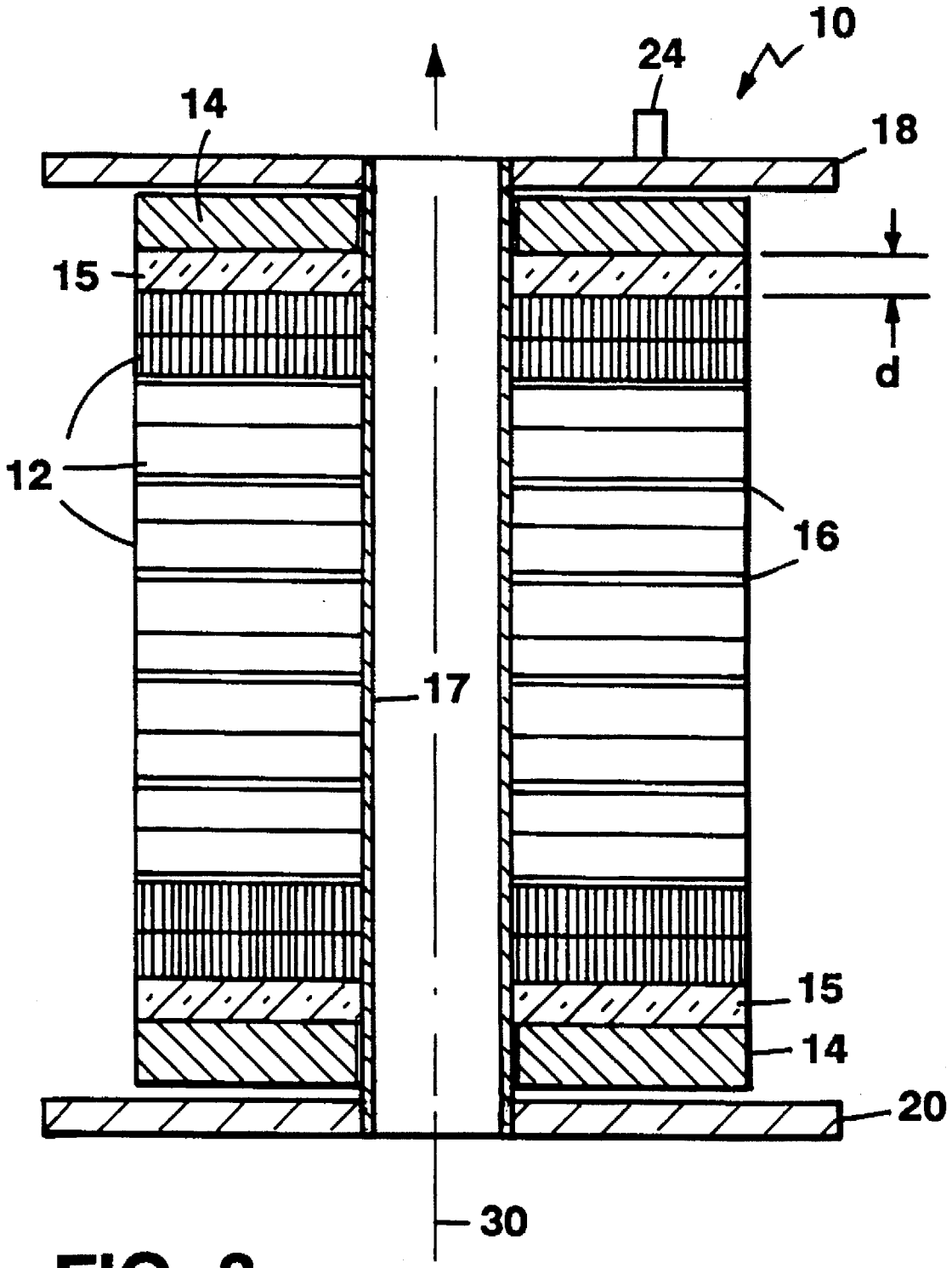
FIG. 3 is a cross-sectional view of FIG. 2 taken along line 3—3.

Referring to FIGS. 2–3, a mechanically robust, high-performance superconducting coil assembly 10 combines multiple double "pancake" coils 12, here, seven separate pancake sections, each having co-wound composite conductors. An iron flange 14 is positioned at each end of the coil assembly 10, each sized to have inner and outer diameters commensurate with the diameters of the pancake coils. Flanges 14 are fabricated from soft iron, for example, 1040 steel (available from Bethlehem Steel Inc., Bethlehem, Pa.), a high grade iron having ferromagnetic properties desirable in magnetic applications. Iron flanges 14 are spaced from an adjacent pancake coil 12 with insulative spacers 15, fabricated from a non-magnetic material, for example G-10 plastic.

Each double "pancake" coil 12 has co-wound conductors wound in parallel which.are then stacked coaxially on top of each other, with adjacent coils separated by a layer of insulation 16. The illustrated conductor is a high temperature copper oxide ceramic superconducting material, such as $Bi_2Sr_2Ca_2Cu_3O$, commonly designated BSCCO (2223). The method of fabricating double pancake superconducting coils is described in co-pending application Ser. No. 08/188,220, assigned to the present assignee, and incorporated herein by reference.

An inner support tube 17 supports coils 12 and iron flanges 14 with a first end member 18 attached to the top of inner support tube 17 and a second end member 20 threaded onto the opposite end of the inner support tube in order to compress the double "pancake" coils. Inner support tube 17 and end members 18, 20 are fabricated from a non-magnetic material, such as aluminum or plastic (for example, G-10). In some applications, inner support tube 16 and end flanges 18, 20 can be removed to form a free-standing coil assembly.

Electrical connections consisting of short lengths of superconducting material (not shown) are made to join the individual coils together in a series circuit. A length of superconducting material 22 also connects one end of coil assembly 10 to one of the termination posts 24 located on end member 18 in order to supply current to coil assembly 10. The current is assumed to flow in a counter-clockwise direction as shown in FIG. 3, with the magnetic field vector 26 being generally normal to end member 18 (in the direction of axis 30) which forms the top of coil assembly 10.

For conventional magnetic coils using non-superconducting materials (for example, copper), the current carrying capacity is substantially constant throughout the windings of the conductor. On the other hand, with low temperature superconductors, the critical current is dependent only on the magnitude of the magnetic field and not its direction, while the current carrying capacity of a high temperature superconductor is not only a function of the magnitude but the angular orientation of the magnetic field.

To illustrate the dependence of the angular orientation of the magnetic field with respect to position within the winding on the current carrying capacity of a coil, a uniform current density superconducting magnetic coil having a coil length (L) of 4 cm and inner and outer winding diameters of 1 and 3 cm, respectively, was analyzed. A commercially available finite element magnetic field analysis software program, OPERA-2d, a product of Vector Fields, Ltd., Oxford, England, was used to generate the field distribution data shown in FIGS. 4–6 for the coil.

Figure 4:
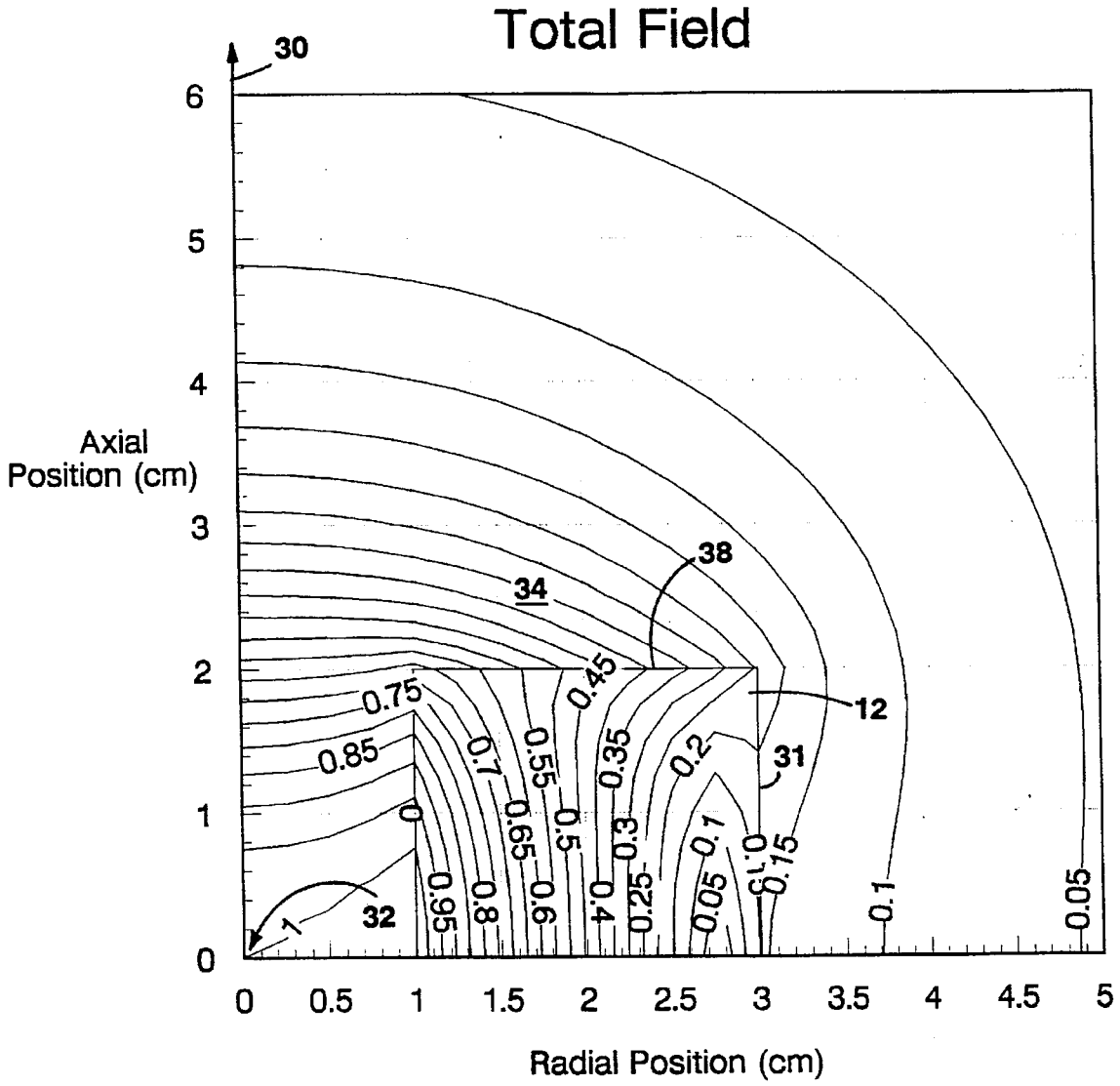
FIG. 4 is a plot showing the magnitude of the total magnetic field distribution within a superconducting coil having a uniform current distribution.
Figure 5:
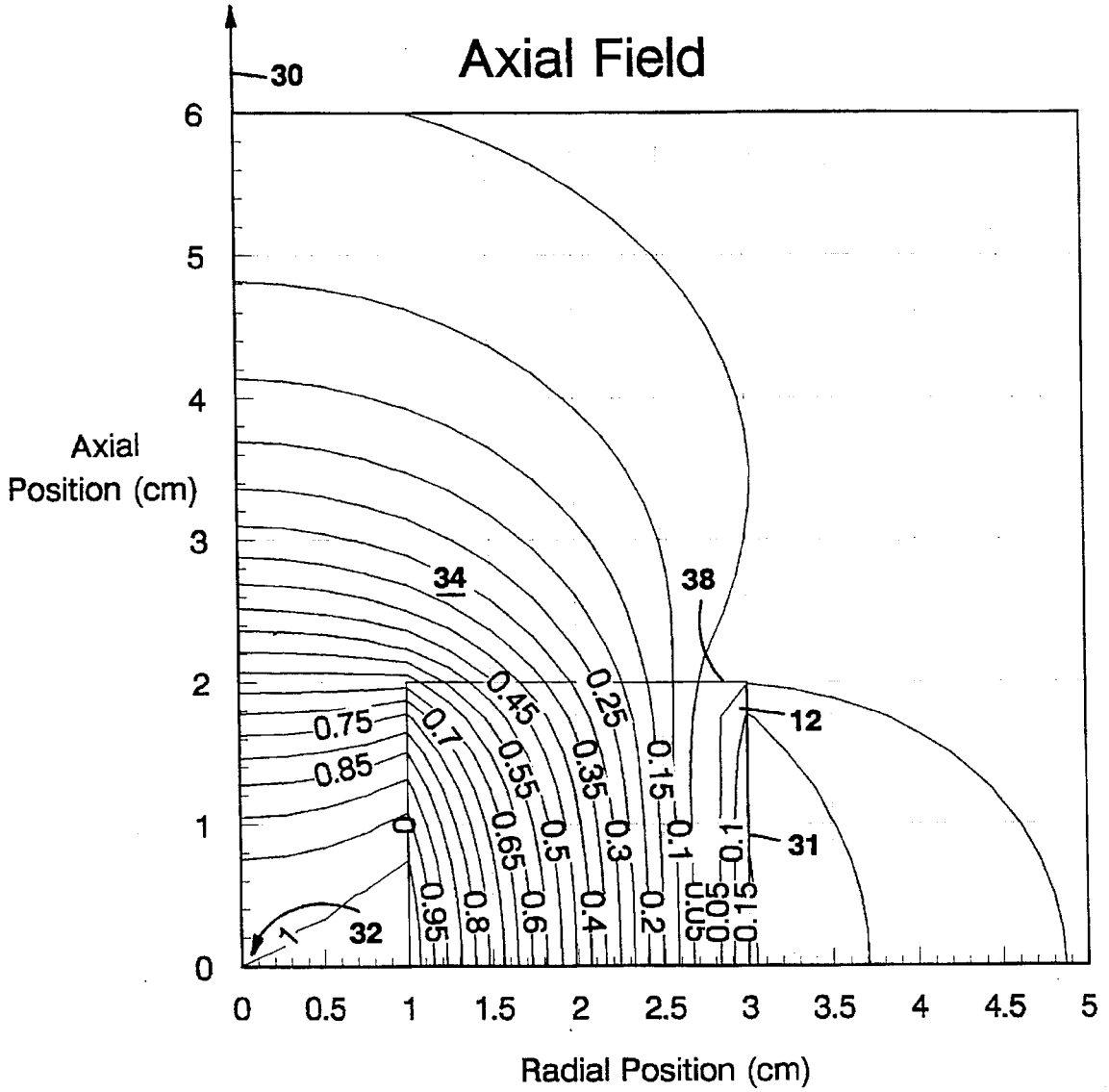
FIG. 5 is a plot showing the magnitude of the axial component distribution of the magnetic field distribution within the uniform current density superconducting coil.
Figure 6:
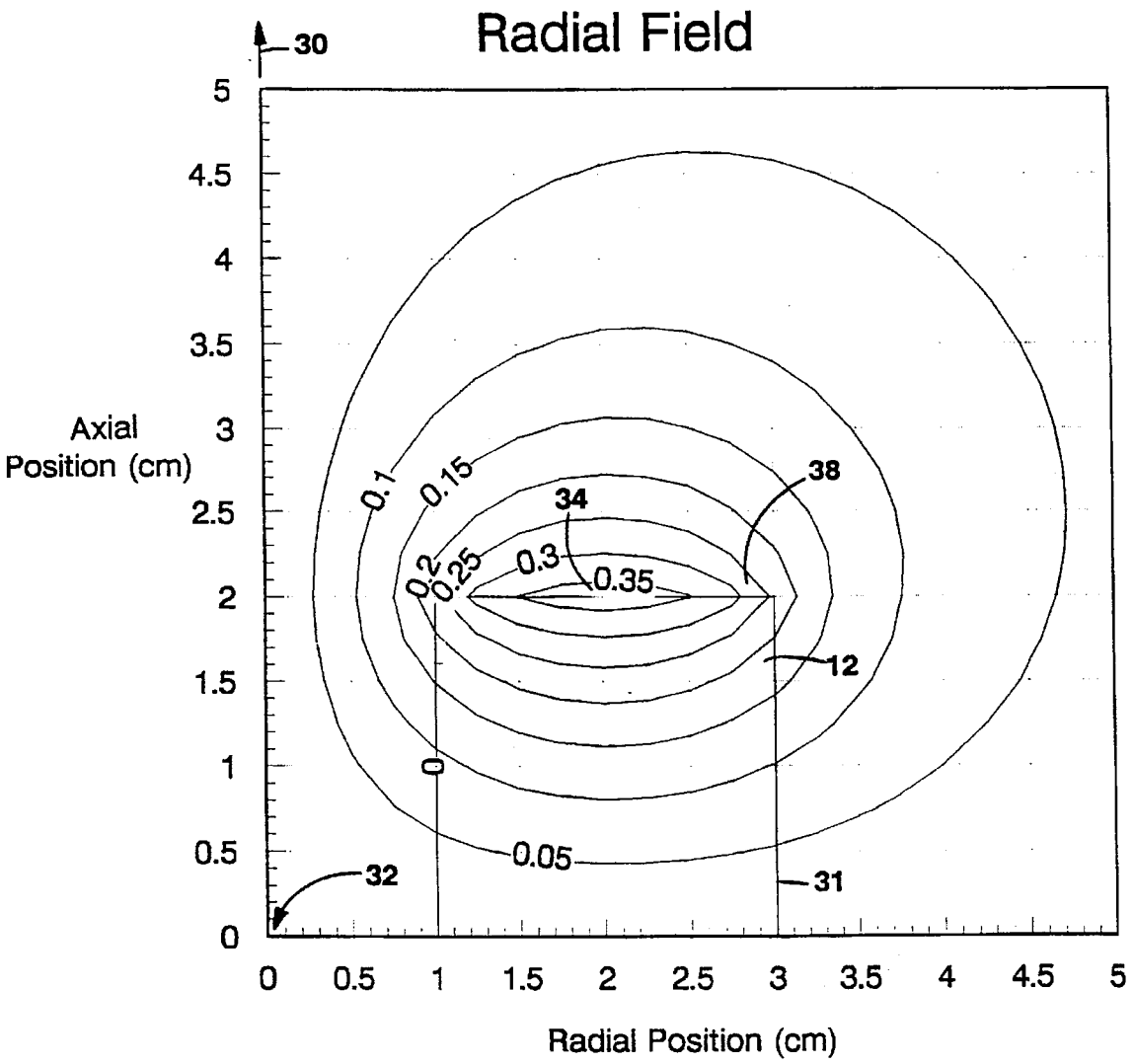
FIG. 6 is a plot showing the magnitude of the radial component of the magnetic field distribution within the uniform current density superconducting coil.

Referring to FIGS. 4–6, plots are shown indicating the total, axial, and radial magnetic field intensities, respectively, for points extending both radially and axially from the center of the magnetic coil. The vertical axes of the plots represent a longitudinal axis 30 (FIG. 3) running through the center of coil assembly 10 while the horizontal axis represents a plane bisecting the length of the coil assembly. In this example, the values of the total field are normalized to a center magnetic field value of one Tesla found at point 32 at the center of coil assembly 10. This region of high magnetic field is consistent with the region in which the magnetic field is generally parallel with longitudinal axis 30 of coil assembly 10. This characteristic is further supported, as shown in FIG. 5, where the axial component of the magnitude of the magnetic flux is greatest along a central region 32 of coil assembly 10. On the other hand, as shown in FIG. 6, the magnitude of the radial component of the magnetic field indicates that central region 32 of coil assembly 10 has a negligible radial component, which gradually increases substantially to a maximum normalized value of about 0.35 at the region 34 of coil assembly 10. In other words, the radial component of the magnetic field found at end region 34 has a normalized radial component ($B_r/B_o$) which is 0.35 of the maximum total magnetic field found at its central region 32. Depending on the particular coil geometry, the maximum normalized value of the radial component is generally less than about 0.50 at end region 34 of coil assembly 10.

Figure 7:
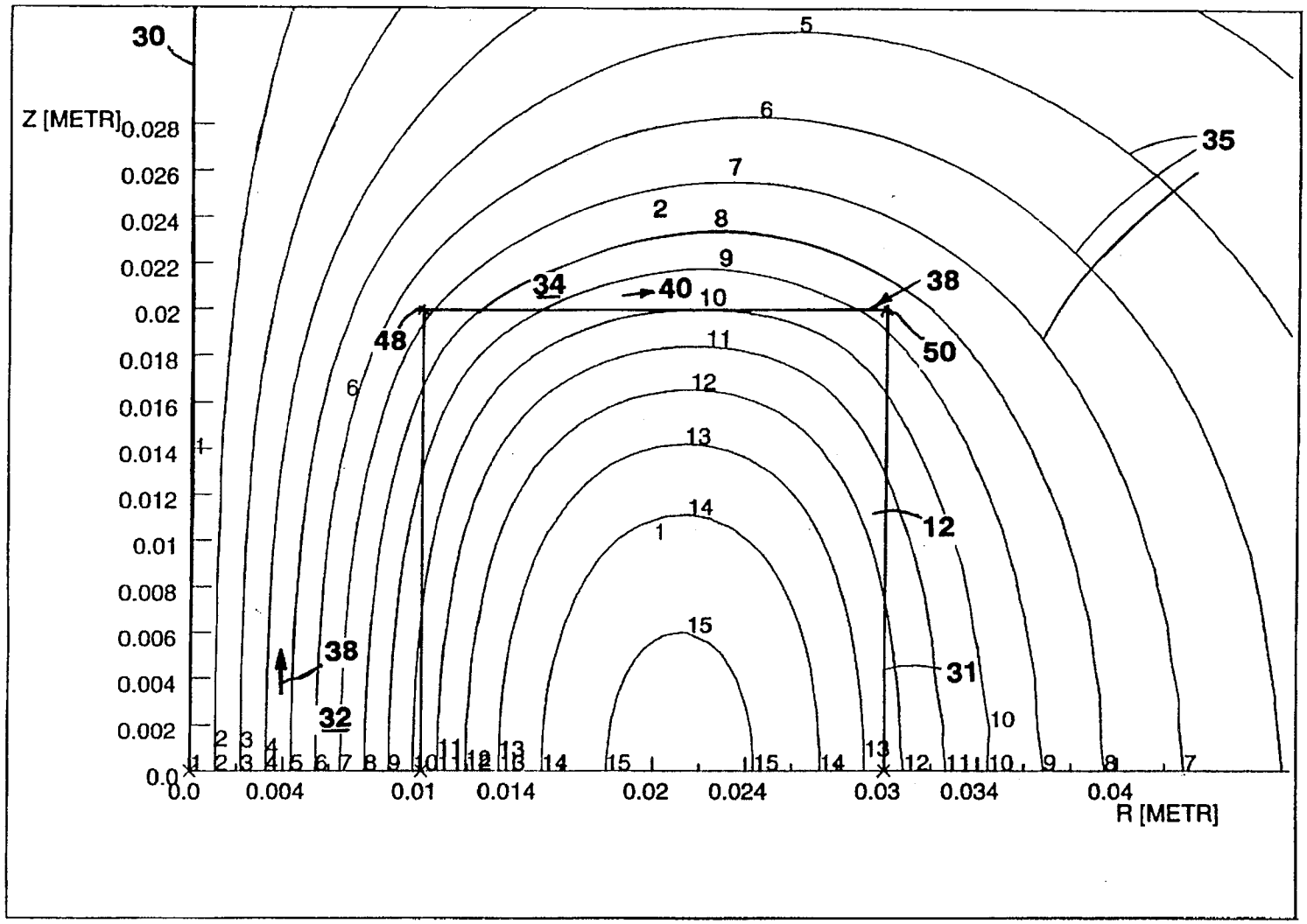
FIG. 7 is a diagrammatic side view of the superconducting coil of FIG. 2 without ferromagnetic flanges showing the magnetic potential contours of the coil.

It is often helpful to characterize a magnetic coil in terms of contours of constant magnetic potential or flux lines. As shown in FIG. 7, the spacing between potential lines 35 provide an indication of the relative magnitude of the magnetic field with the spacing decreasing with increasing magnitude. In addition, the direction of the magnitude field is tangent to potential lines. With this in mind, in coil assembly 10 without ferromagnetic flanges, the magnetic field lines in central region 32 are generally parallel (indicated by an arrow 38) with longitudinal axis 30 of coil assembly 10 and become less so as the magnetic field lines extend away from central region 32 and towards end regions 34 of coil assembly 10. Indeed, the orientation of field lines 35 at end regions 34 (indicated by an arrow 40) become substantially perpendicular with respect to axis 30.

Figure 8:
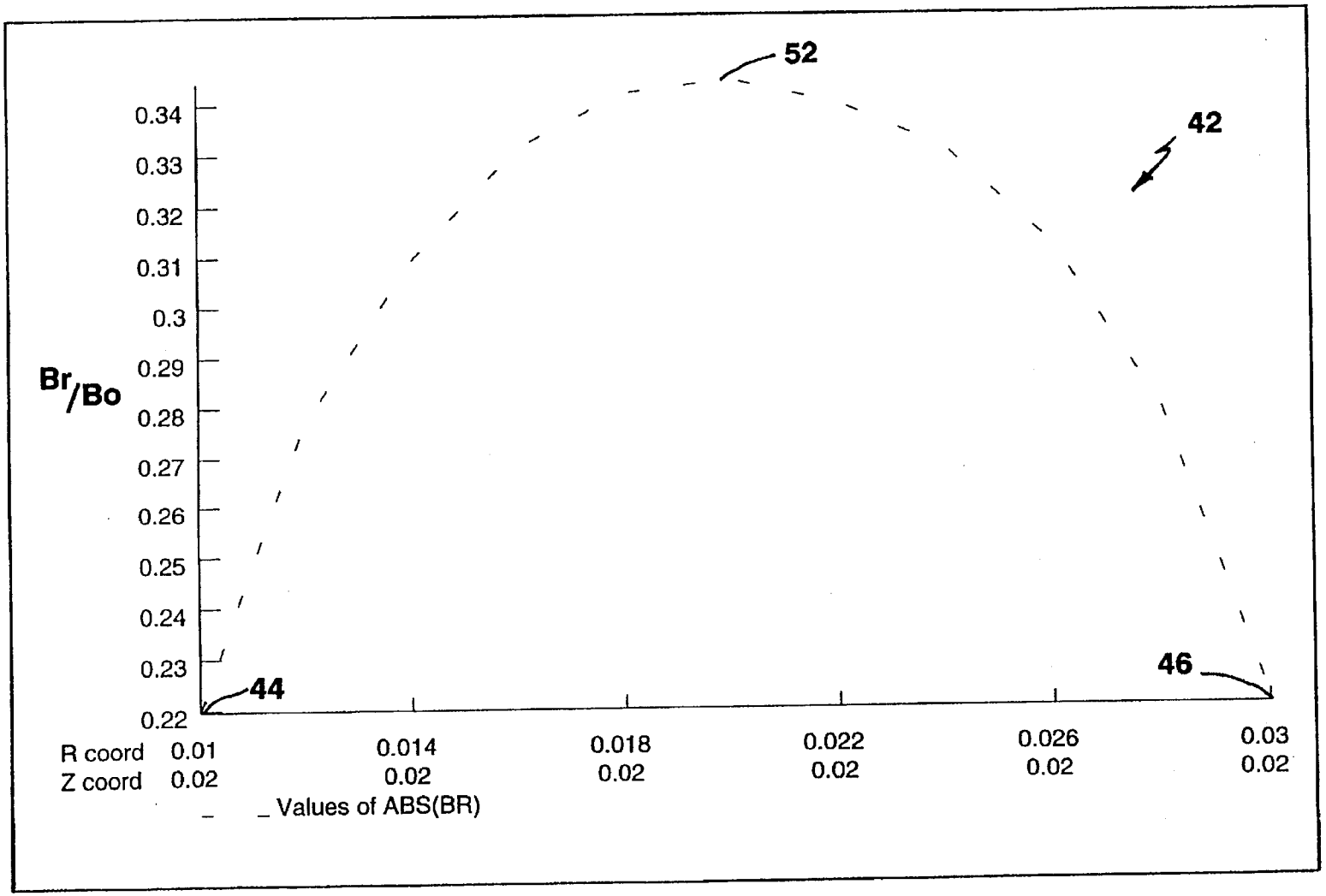
FIG. 8 is a plot showing the normalized radial field component of the magnetic field as a function of the radial distance within the superconducting coil of FIG. 7 measured at the end of the coil.

Referring to FIG. 8, a plot 42 shows the radial magnetic field component (vertical axis) as a function of radial distance from axis 30 of the coil (horizontal axis) at end surface 38 of coil assembly 10 with points 44, 46 of FIG. 8 corresponding to points 48, 50 on FIG. 7. It can be seen that the normalized maximum radial magnetic field component is about 0.35 (point 52) along end surface 38 at a position about half the distance of the radial thickness of coil assembly 10.

Figure 9:
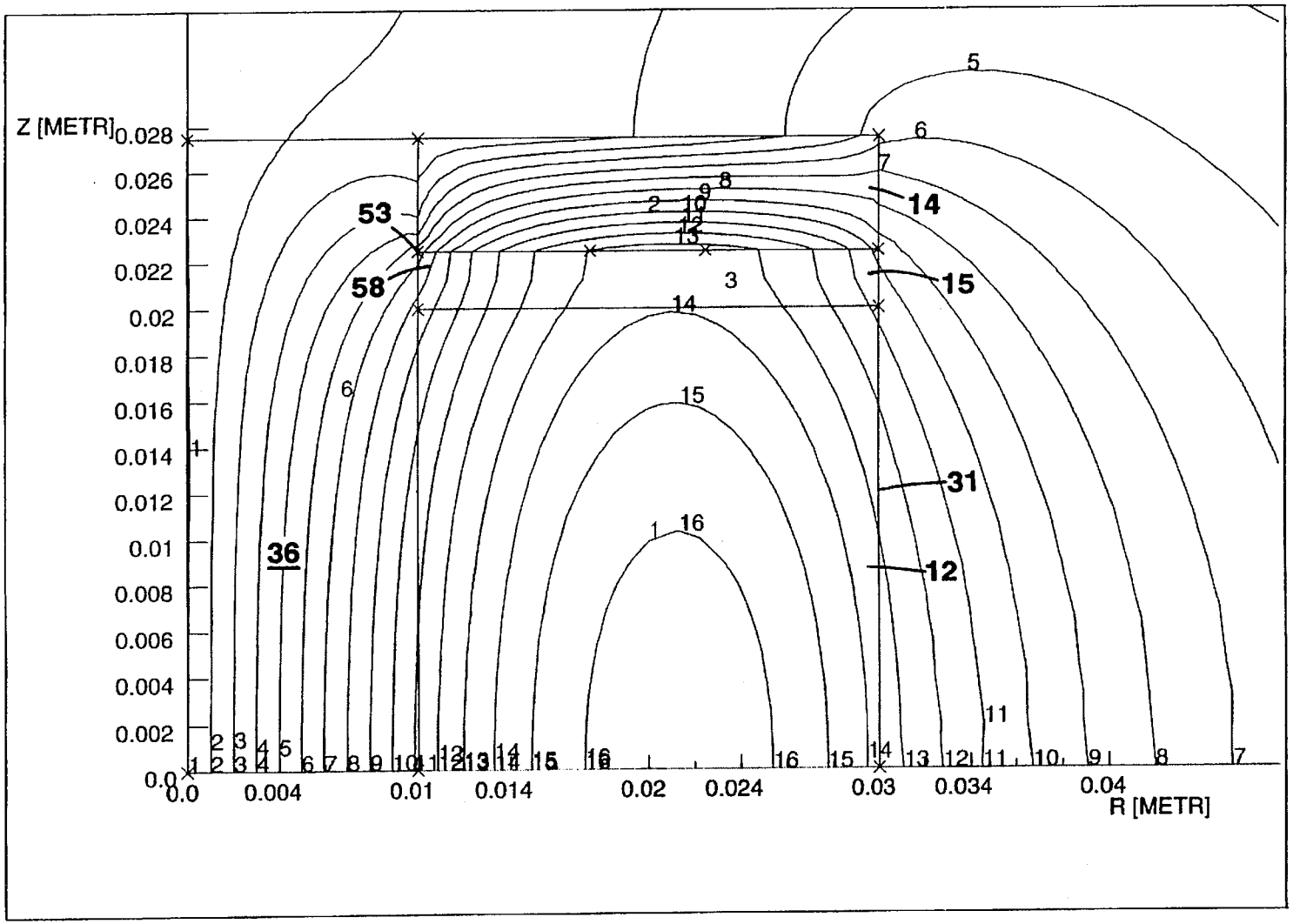
FIG. 9 is a diagrammatic side view of the superconducting coil of FIG. 2 with ferromagnetic flanges showing the magnetic potential contours of the coil.

Referring to FIG. 9, positioning ferromagnetic flanges 14 at end regions 34 of the superconducting coil assembly 10 substantially changes the orientation of the magnetic field at end regions 34. For this embodiment, ferromagnetic flanges 14 have a thickness of 5 mm and are spaced from end regions 34 by a distance of 2.5 mm. Unlike the embodiment shown above in FIG. 7, the magnetic flux contours are drawn toward ferromagnetic flange 14 and maintain a relatively parallel orientation with respect to axis 30 of coil assembly 10, thereby reducing the perpendicular magnetic field within the winding. It is only after a substantial amount of flux is drawn within the flanges that the flux contours bend around toward the opposite end of the coil. The relative spacing of flange 14 from the end of the coil winding is determined so that a minimum perpendicular magnetic field is achieved while the thickness of flange 14 is selected to provide a maximum flux density below the saturation flux density of the flange 14.

Figure 10:
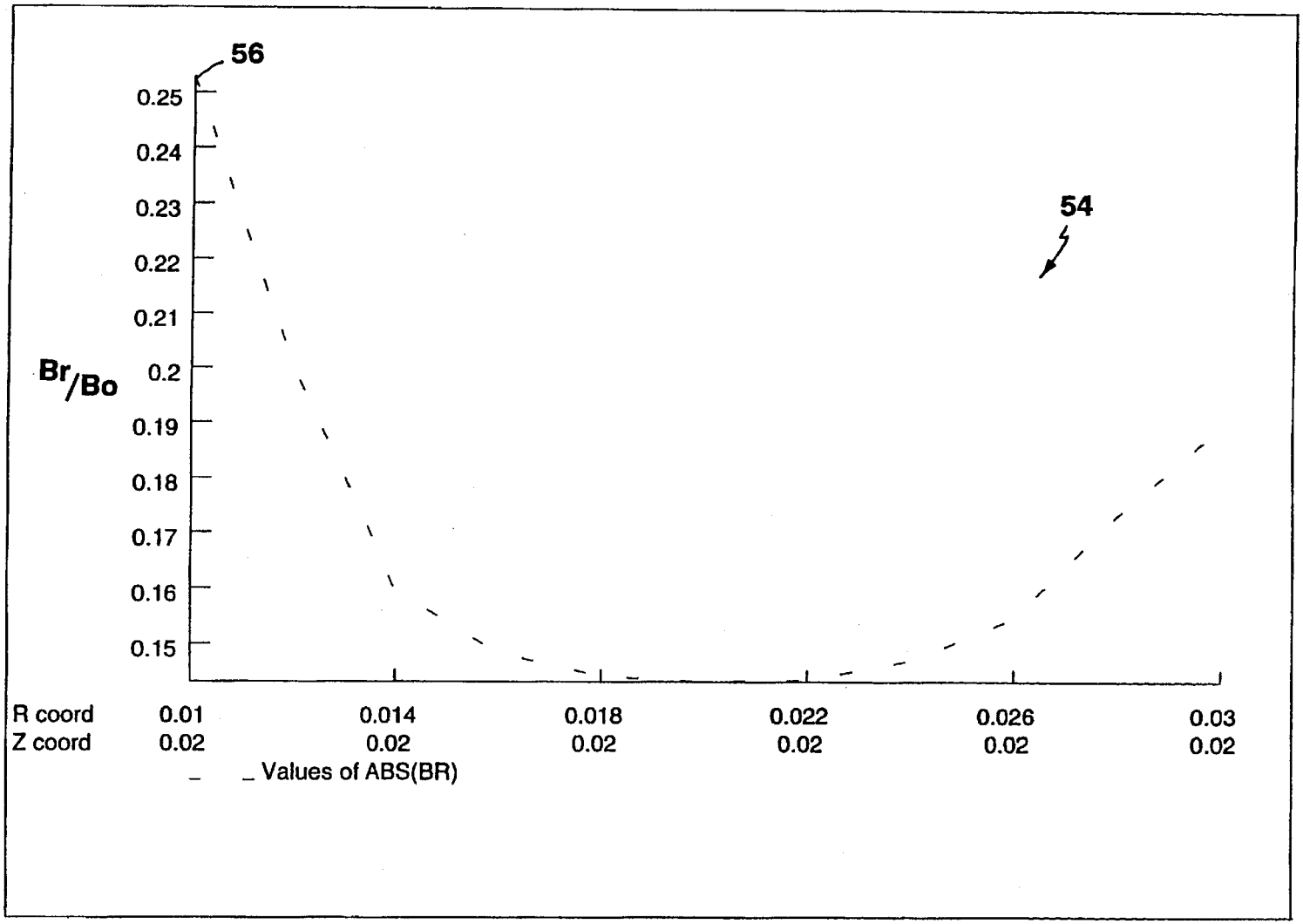
FIG. 10 is a plot showing the normalized radial field component of the magnetic field as a function of the radial distance within the superconducting coil of FIG. 9 measured at the end of the coil.

As shown in FIG. 10, a corresponding plot 54 of the radial component of the magnetic field indicates that the normalized radial component of the magnetic field has been significantly reduced across the entire radius of coil assembly 10. Moreover, the maximum normalized radial component has decreased from 0.35 to 0.26 and has shifted to point 56, corresponding to the innermost edge of coil (point 58 of FIG. 9).

Referring again to FIG. 9, it is important to note that the potential lines within central region 36 of coil 10 are more closely spaced than potential lines in central region 36 of FIG. 7 indicating that the magnetic field has also increased within coil 10. Furthermore, it can be seen that the close spacing of flux lines 35 at the innermost corner 53 of flange 14, indicates a relatively large magnetic field in the region of point 58.

Figure 11:
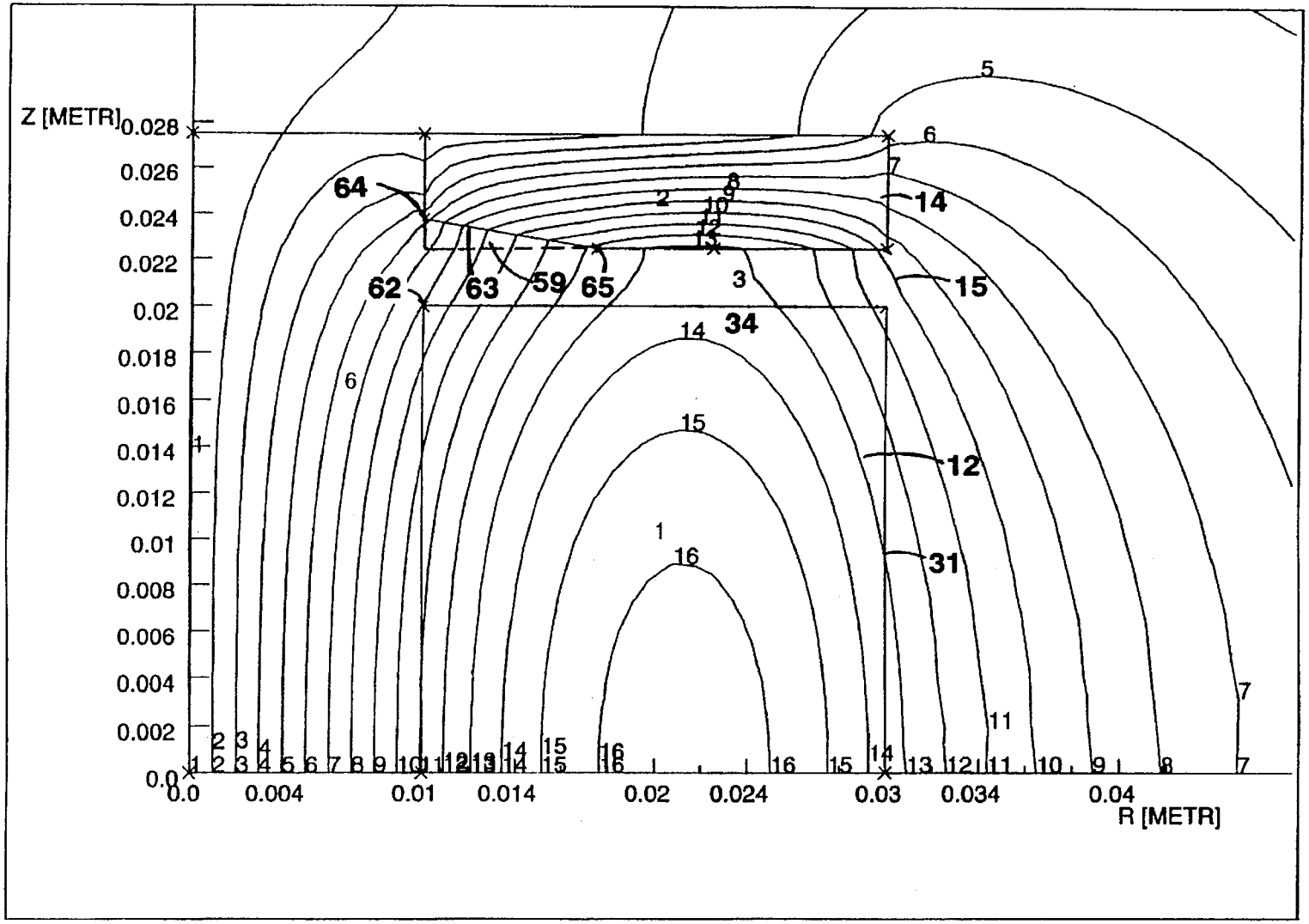
FIG. 11 is a diagrammatic side view of the superconducting coil showing the magnetic potential contours of the coil using an alternate embodiment of ferromagnetic flanges.
Figure 12:
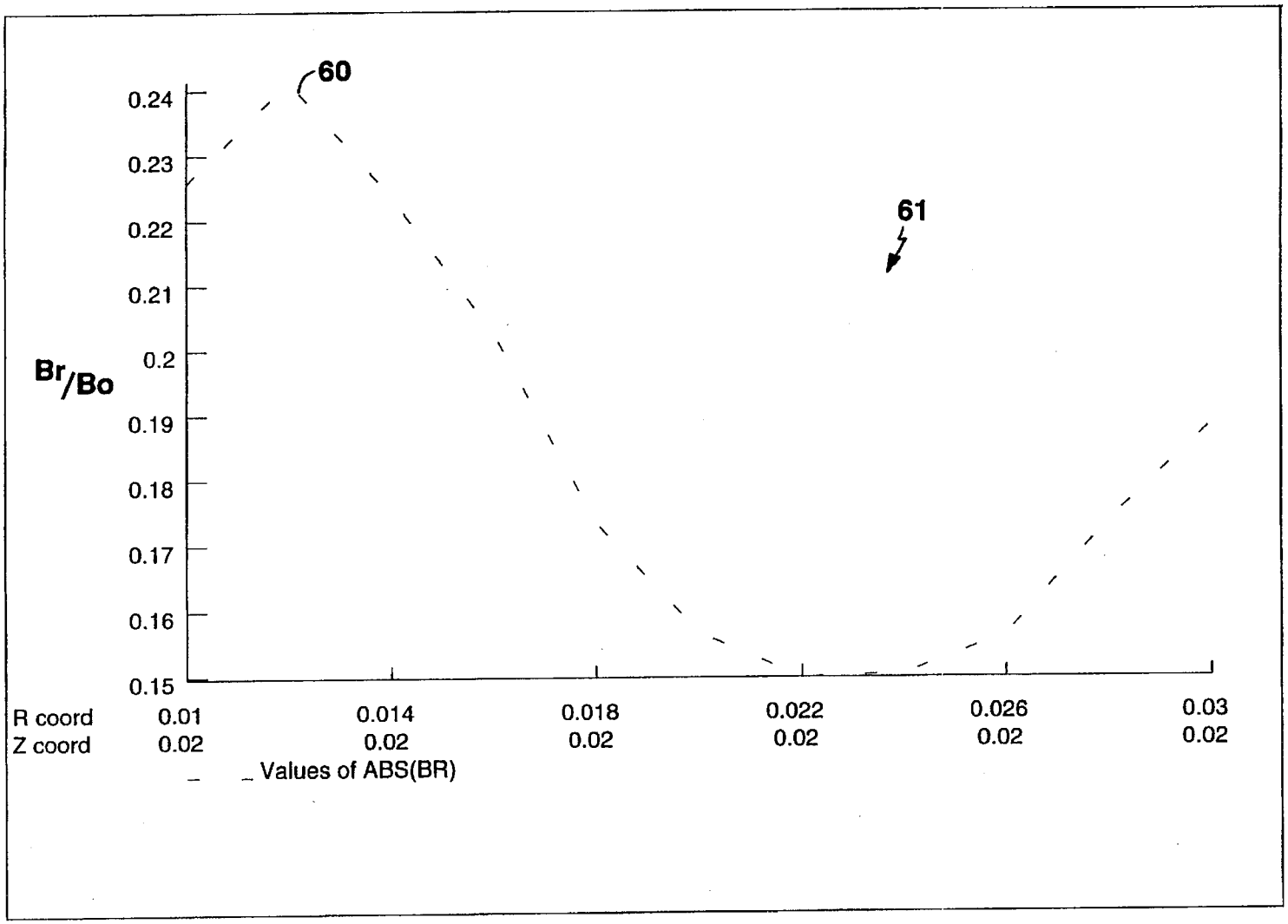
FIG. 12 is a plot showing the normalized radial field component of the magnetic field as a function of the radial distance within the superconducting coil of FIG. 11 measured at the end of the coil.

Referring to FIG. 11, to reduce the magnetic field in the region of point 58 of FIG. 9, a corner portion 59 of the ferromagnetic material of flange 14 is removed. Corner portion 59 is defined by a line 63 extending axially from a point 64, 1.25 mm from the inner wall of flange 14, to a point 65, extending radially 7.5 mm along the surface adjacent end region 34 of the coil. As shown in FIG. 12, this change in geometry of flange 14 provides a further decrease in the maximum normalized radial component of the magnetic field to about 0.24 at point 60 of plot 61. The decrease in maximum normalized radial component is consistent with the orientation of flux lines 35 shown in FIG. 11 where it can also be seen that the removal of material in the region of point 62 (FIG. 11), provides flux lines that are more axial than those in conjunction with either the flange-less embodiment of FIG. 7 or the uniform thickness flange embodiment of FIG. 9.

Figure 13:
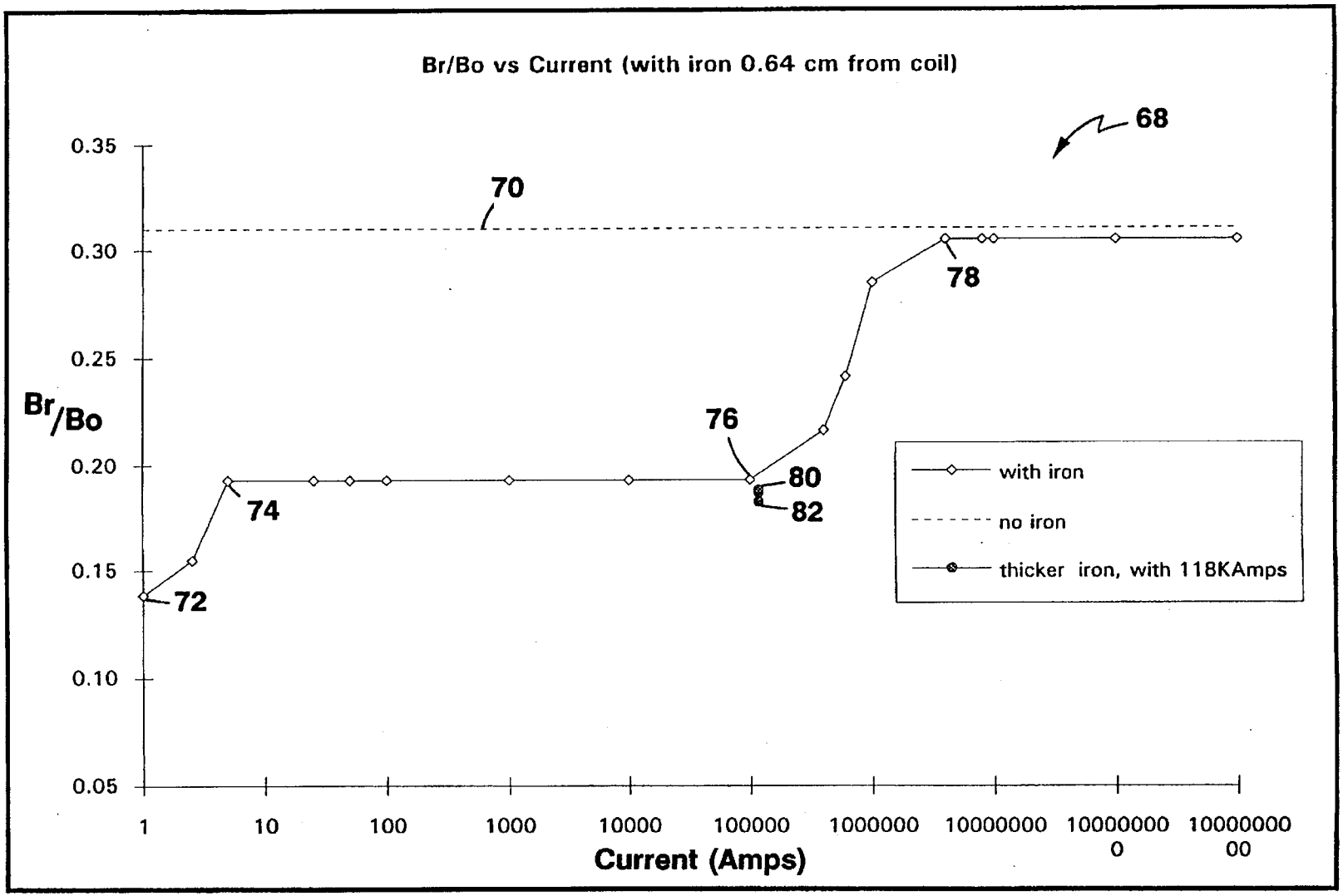
FIG. 13 is a plot of the normalized maximum perpendicular magnetic field as a function of current in units of ampere-turns.

The effect of providing a ferromagnetic flange to end regions of a superconducting coil becomes more apparent with respect to the graph 68 shown in FIG. 13 which shows the normalized radial magnetic field ($B_r/B_o$) as a function of applied current through the coil. As indicated by dashed line 70, the magnetic radial field at the end region of the coil without ferromagnetic flanges is about 0.31 of the magnetic field of the coil measured at the center of the coil (i.e., the maximum magnetic field of the coil). On the other hand, positioning a ferromagnetic flange 0.64 cm from the end of the coil provides a significant drop in the radial magnetic field to an initial value (point 72) of about 0.14 at low current levels. The normalized radial magnetic field increases to about 0.19 for an extended current range between about 10 and 100,000 amperes (point 74). At the current level of about 100,000 amperes the ferromagnetic plate becomes saturated limiting the amount of magnetic flux that can be coupled within the plate. In this condition, designated by point 76, the radial magnetic field slowly begins to rise until the current level reaches a point 78 at which the ferromagnetic flange provides no additional effect.

As indicated by points 80, 82, the saturation point can be shifted to a higher current level by increasing the thickness of the ferromagnetic flange to 10 mm and 12 mm, respectively, thereby increasing the amount of magnetic flux which can be coupled within the flange.

Figure 14:
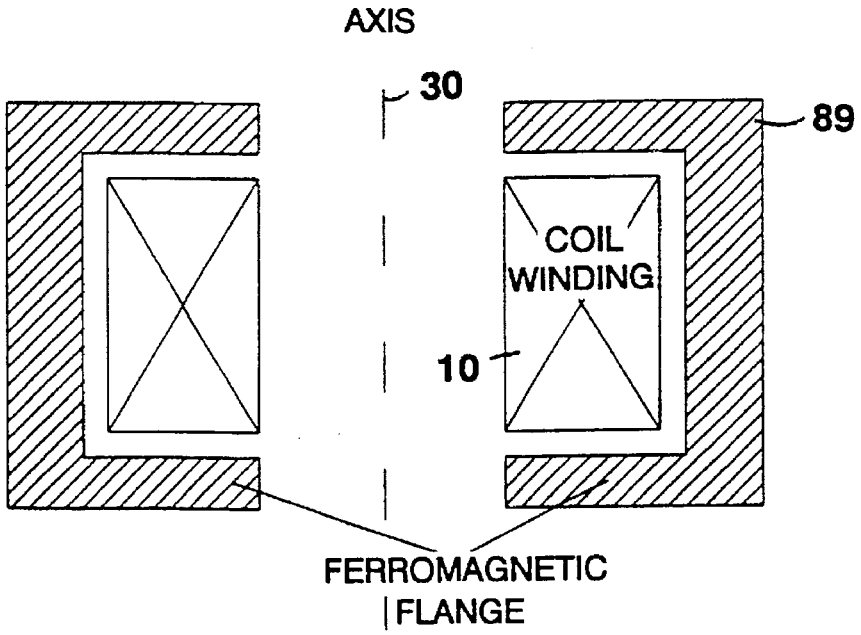
FIG. 14 is a diagrammatic side view of an alternate embodiment of the invention.

Other embodiments are within the claims. For example, the inner and outer diameters of iron flanges 14 need not necessarily be commensurate with the diameters of the pancake coils. In most applications, the inner diameter of the iron flange is desired to be not less than the inner diameter of the coil so as not to limit access to what is generally the "working volume" of the coil. However, as shown in FIG. 14, the outer diameter of the iron flange may extend beyond the outer diameter of coil 10 and even wrap around to connect with the iron flange at the opposite end of the coil providing a single iron enclosure 89 providing a ferromagnetic path that envelopes coil 10. This arrangement, although larger and heavier, is useful in applications where other instruments are desired to be shielded from the magnetic field of coil 10.

Figure 15:
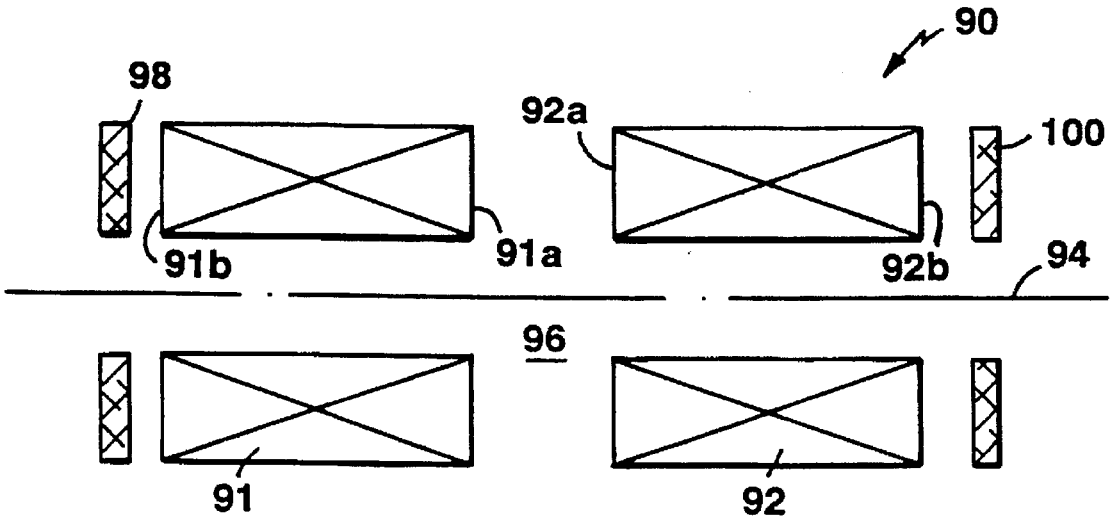
FIG. 15 is a diagrammatic side view of an alternate embodiment of the invention.

The positioning of ferromagnetic flanges may be used where superconducting coils are placed end-to-end in what is commonly referred to as a Helmholtz pair configuration. A coil assembly of this type is commonly used in applications where it is desired to provide a uniform axial magnetic field over relatively long lengths. For example, referring to FIG. 15, a coil assembly 90 includes superconducting coils 91, 92 positioned along an axis 94 with respective ends 91*a* and 92*a* spaced by a predetermined distance (d) so that, in region 96, between ends 91*a*, 92*a*, the direction of the radial components of their magnetic fields oppose each other and cancel, thereby providing a relatively uniform axial field along the length of the coil assembly. In this configuration, ferromagnetic flanges 98, 100 are provided only to the outermost ends 91*b*, 91*b* of coils 91, 92 to reduce the perpendicular field component of the magnetic fields at the end regions of coil assembly 90.

Further, although iron and its magnetic alloys have been described for use in fabricating flanges 14, other ferromagnetic materials including transformer steel, nickel alloys, rare-earth elements, and terbium-dysprosium-iron may also be used. Coil assembly 10 may be "layer-wound" where the layers of superconducting tape are wound along the length of the coil in one direction and then back again along the length in the opposite direction. Winding in this manner is repeated until a desired number of turns is achieved. In certain applications, compressively loading pancake coils 12 and positioning spacers 19 between the outermost coils and iron flanges 14 may not be required. In addition, although a uniform current density coil was described above to illustrate the dependence of the angular orientation of the magnetic filed on the current carrying capacity of the coil, the invention is equally applicable to coil constructions having non-uniform windings.

What is claimed is:

1. A magnetic coil comprising:

an anisotropic superconductor wound about a longitudinal axis of the coil, the coil generating a magnetic field that varies along the longitudinal axis, and a ferromagnetic member disposed proximally to and spaced from at least one end portion of the coil for reducing perpendicular magnetic field components of the magnetic field at the at least one end portion of the coil, wherein the ferromagnetic member has inner and outer radial portions radially disposed proximally and distally from said longitudinal axis, respectively, said inner and outer radial portions axially spaced from the at least one end portion of coil by first and second distances, said first distance greater than said second distance.

2. The magnetic coil of claim 1 wherein the inner radial portion proximal of the coil has a thickness less than a thickness at the outer radial portion.

3. The magnetic coil of claim 1 wherein a ferromagnetic member is disposed proximally to and spaced from each end of the coil.

4. The magnetic coil of claim 1 wherein the ferromagnetic member comprises a material selected from the group consisting of iron, cobalt, nickel, gadolinium, holmium, terbium, dysprosium, or alloys thereof.

5. The magnetic coil of claim 1 wherein the anisotropic superconductor is a high temperature superconductor.

6. The magnetic coil of claim 1 wherein the anisotropic superconductor is formed as a superconductor tape comprising a multi-filament composite superconductor including individual superconducting filaments which extend the length of the multi-filament composite conductor and are surrounded by a matrix-forming material.

7. The magnetic coil of claim 1 wherein the sections of the superconductor are formed of pancake coils.

8. The magnetic coil of claim 1 wherein the sections of the superconductor are formed of double pancake coils.

9. A superconducting magnetic coil assembly comprising:

superconducting magnetic coils coaxially positioned and spaced from an adjacent coil along a longitudinal axis of the coil assembly, each coil comprising an anisotropic superconductor wound about the longitudinal axis of the coil, the coil generating a magnetic field that varies along the longitudinal axis, and a ferromagnetic member disposed proximally to and spaced from at least one of said coils positioned at an outermost end region of said coil assembly for reducing perpendicular magnetic field components of the magnetic field at the outermost end region of the coil assembly, wherein the ferromagnetic member has an inner radial portion substantially coextensive with an inner diameter of the at least one coil positioned at the outermost end region of the coil assembly.

10. A method for providing a magnetic coil formed of a preselected anisotropic superconductor material wound about a longitudinal axis of the coil, said magnetic coil having a ferromagnetic member positioned proximal to at least one end region of the coil, the method comprising the steps of:

a) selecting a thickness of the ferromagnetic member to provide a maximum flux density below a saturation flux density of the member, b) positioning a ferromagnetic member at said at least one end region of the coil, and c) spacing the ferromagnetic member along the longitudinal axis of the coil to provide a minimum perpendicular magnetic field component at the end region of the coil.

11. The method of claim 10 further comprising the steps of:

a) determining, at the end region of the coil, the radial position at which the end perpendicular field component is at a maximum, and b) removing a portion of the ferromagnetic material at the radial position corresponding to the maximum perpendicular field component.

12. A magnetic coil comprising:

an anisotropic superconductor wound about a longitudinal axis of the coil, the coil generating a magnetic field that varies along the longitudinal axis, and a ferromagnetic member disposed proximally to and spaced from at least one end portion of the coil for reducing perpendicular magnetic field components of the magnetic field at the at least one end portion of the coil, wherein the ferromagnetic member has an inner radial portion substantially coextensive with an inner diameter of the coil.

* * * * *